US007037083B2

(12) United States Patent
O'Neil et al.

(10) Patent No.: US 7,037,083 B2
(45) Date of Patent: May 2, 2006

(54) RADIATION SHIELDING COATING

(75) Inventors: James A. O'Neil, Bedford, MA (US); Gary S. Ash, Dartmouth, MA (US)

(73) Assignee: Brooks Automation, Inc., Chelmsford, MA (US)

( * ) Notice: Subject to any disclaimer, the term of this patent is extended or adjusted under 35 U.S.C. 154(b) by 0 days.

(21) Appl. No.: 10/339,181

(22) Filed: Jan. 8, 2003

(65) Prior Publication Data

US 2004/0131478 A1 Jul. 8, 2004

(51) Int. Cl.
*F04B 17/00* (2006.01)
*B01D 8/00* (2006.01)

(52) U.S. Cl. ..... 417/53; 417/373; 417/572; 417/901; 62/55.5

(58) Field of Classification Search ..... 417/53, 417/313, 373, 572, 901; 62/55.5, 268
See application file for complete search history.

(56) References Cited

U.S. PATENT DOCUMENTS 3,256,706 A 6/1966 Hansen
3,321,927 A 5/1967 Hood, Jr.
4,121,430 A * 10/1978 Bachler et al. ..... 62/55.5
4,150,549 A 4/1979 Longsworth
4,212,170 A 7/1980 Winkler
4,219,588 A 8/1980 Longsworth
4,275,566 A 6/1981 Bonn
4,336,690 A 6/1982 Welch
4,356,701 A 11/1982 Bartlett et al.
4,446,702 A 5/1984 Peterson et al.
4,454,722 A 6/1984 Bartlett et al.
4,474,036 A 10/1984 Ball et al.
4,499,354 A * 2/1985 Hill et al. ..... 219/634
4,546,613 A * 10/1985 Eacobacci et al. ..... 62/55.5
4,679,401 A 7/1987 Lessard et al.
4,691,534 A 9/1987 Lombardini et al.
4,815,303 A * 3/1989 Duza ..... 62/55.5
4,834,136 A * 5/1989 Bourke et al. ..... 137/549
4,860,546 A 8/1989 Harvell et al.
4,862,697 A * 9/1989 Tugal et al. ..... 62/55.5
4,873,833 A * 10/1989 Pfeiffer et al. ..... 62/55.5
5,083,445 A 1/1992 Saho et al.
5,156,007 A 10/1992 Bartlett et al.

(Continued)

OTHER PUBLICATIONS

Mark's Standard Handbook for Mechanical Engineers, 10th edition, McGraw-Hill, Boston Massachusetts; 1996, pp. 4-62 and 4-64.*

(Continued)

*Primary Examiner*—Charles G. Freay
(74) *Attorney, Agent, or Firm*—Hamilton, Brook, Smith & Reynolds, P.C.

(57) ABSTRACT

A vacuum conduit connected to a vacuum pump has a shield surface which absorbs radiation to reduce the total radiation falling on the vacuum pump. The vacuum system includes the vacuum conduit connected between a process chamber and the vacuum pump and a surface treatment along at least a portion of the shield surface adapted to absorb radiation. Since the treatment is on the interior surface of the vacuum conduit and does not extend into the center of the conduit, gaseous flow to the pump is not impeded. In this manner radiation entering the vacuum pump and falling on the cryogenic array is reduced without impeding gaseous flow to the cryogenic surface. The system therefore minimizes the radiation load on the cryogenic array in the vacuum pump without impeding the gaseous flow through the vacuum pump.

20 Claims, 7 Drawing Sheets

U.S. PATENT DOCUMENTS 5,483,803 A 1/1996 Matte et al.
5,537,833 A 7/1996 Matte et al.
5,542,257 A 8/1996 Mattern-Klosson et al.
5,548,964 A * 8/1996 Jinbo et al. ..... 62/55.5
5,906,102 A 5/1999 Bartlett et al.
5,906,103 A 5/1999 Matte
6,038,867 A 3/2000 Einziger et al.
6,053,704 A 4/2000 Yamamoto et al.
2003/0010383 A1 1/2003 Matte et al.

OTHER PUBLICATIONS

US 4,266,959, 05/1981, Welch (withdrawn)

* cited by examiner

RADIATION SHIELDING COATING

BACKGROUND

Vacuum process chambers are often employed in manufacturing to provide a vacuum environment for tasks such as semiconductor wafer fabrication, electron microscopy, gas chromatography, and others. Such chambers are typically achieved by attaching a vacuum pump to the vacuum process chamber by a vacuum connection such as a flange and a conduit. The vacuum pump operates to remove substantially all of the molecules from the process chamber, therefore creating a vacuum environment.

A cryogenic vacuum pump, known as a cryopump, employs a refrigeration mechanism to achieve low temperatures that will cause many gases to condense onto a surface cooled by the refrigeration mechanism. One type of cryopump is disclosed in U.S. Pat. No. 5,862,671, issued Jan. 26, 1999 and assigned to the assignee of the present application. Such a cryopump uses a two-stage helium driven refrigerator to cool a cold finger to near 10 degrees Kelvin (K.). Another type of cryopump, often referred to as a water pump is disclosed in U.S. Pat. No. 5,887,438, issued Mar. 30, 1999 and also assigned to the assignee of the present application. A cryogenic water pump is typically employed in conjunction with a turbomolecular pump, and is also used to condense gases onto a helium cooled surface, or cryogenic array, which is cooled to around 100K.

Since the cryogenic arrays are cooled to very low temperatures, heat flow to the cryogenically cooled surface is ideally minimized. Undesired heat increases the time required to cool down the pump, increases the helium consumption of the pump, and influences the minimum temperature the cryopump achieves.

Note that both a cryopump and a waterpump, as disclosed herein, employ one or more refrigerant-cooled surfaces for condensing gases for the purpose of removing the gases from a closed environment such as a process chamber. A waterpump, for example, may be considered functionally equivalent to a cryopump having a single refrigerant-cooled surface, or stage. Accordingly, both a cryopump and a waterpump may benefit from radiation absorption as disclosed herein and therefore, the term "cryopump" may hereinafter be taken to imply either a cryopump or a waterpump.

A radiation shield may be employed around the cryogenic array to minimize the thermal load on the cryogenic array. Such a radiation shield may take the form of an enclosure around the cryogenic array, and may include louvers or chevrons to allow fluid communication with the vacuum process chamber. Louvers and chevrons, however, can interfere with the fluid communication, or gaseous flow, from the vacuum process chamber, decreasing flow rate and efficiency, and, therefore, increasing the time required to achieve the desired vacuum state.

SUMMARY

A radiation shield for such a vacuum system employs a vacuum conduit connected to a vacuum pump, the vacuum conduit having an internal shield surface which absorbs radiation to reduce the total radiation falling on the vacuum pump. Since the surface treatment is on the interior surface of the conduit and does not extend into the center of a fluid path defined by the conduit, gaseous flow to the pump is not impeded. A vacuum system which eliminates the radiation load from the process chamber before the radiation falls on the cryogenic array, and which does not obstruct the flow of gases to the cryogenic array, provides an unimpeded flow of gases while also reducing the radiation load on the cryogenic array. The system therefore minimizes the radiation load on the cryogenic array in the vacuum pump without interfering with the gaseous flow through the vacuum pump.

The use of a surface treatment having a high emissivity causes more radiation from a high temperature source to be absorbed, because emissivity is directly related to absorption, and therefore less radiation from the high temperature source is reflected onto the vacuum pump. Since the vacuum conduit comprising the surface treatment may be a preexisting conduit in the fluid path between the vacuum pump and vacuum process chamber, no additional surface area is introduced into the vacuum system. In this manner, an existing vacuum conduit is adapted to reduce the total radiation load which the cryopump would otherwise need to accommodate by intercepting some incoming thermal radiation and re-radiating it from a lower temperature.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

In a cryogenic vacuum pump, a cooling surface, or cryogenic array, is cooled by a helium refrigerator. As helium remains gaseous at very low temperatures, helium is an ideal refrigerant for a cryogenic process. As the cryogenic array is cooled, it achieves a temperature low enough to condense gases from the vacuum process chamber. As the gases are condensed or adsorbed onto the cryogenic array, a vacuum is created in the vacuum process chamber. The cryogenic array may be cooled to a point at which most gases will condense, or may be cooled to a point at which most of the water vapor will condense, while the remaining gases may be removed by a supplemental vacuum pump such as a turbomolecular pump.

Figure 1:
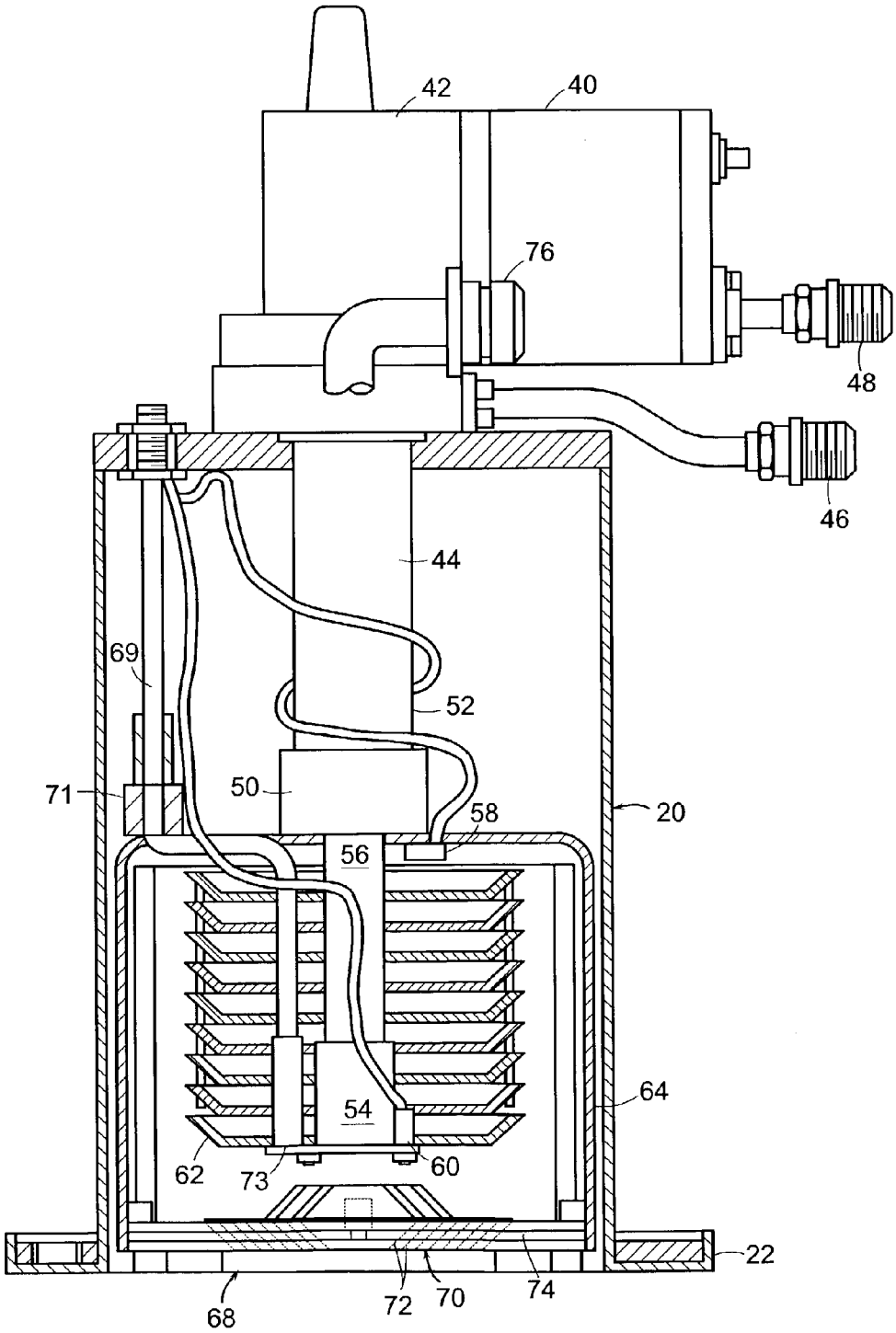
FIG. 1 PRIOR ART
FIG. 1 shows a prior art cryopump adapted to be attached to a valve between a vacuum process chamber and a vacuum pump.

Prior to discussing the invention as defined by the present claims, a discussion of a cryopumping apparatus adapted for a vacuum process chambers may be beneficial. FIG. 1 shows a typical prior art cryopump. The cryopump 20 includes a drive motor 40 and a crosshead assembly 42. The crosshead converts the rotary motion of the motor 40 to reciprocating motion to drive a displacer within the two-stage cold finger 44. With each cycle, helium gas introduced into the cold finger under pressure through line 46 is expanded and thus cooled to maintain the cold finger at cryogenic temperatures. Helium then warmed by a heat exchange matrix in the displacer is exhausted through line 48.

A first-stage heat station 50 is mounted at the cold end of the first stage 52 of the refrigerator. Similarly, heat station 54 is mounted to the cold end of the second stage 56. Suitable temperature sensor elements 58 and 60 are mounted to the rear of the heat stations 50 and 54.

The primary pumping surface is a cryopanel array 62 mounted to the heat station 54. This array comprises a plurality of disks as disclosed in U.S. Pat. No. 4,555,907. Low temperature adsorbent is mounted to protected surfaces of the array 62 to adsorb noncondensible gases.

A cup-shaped radiation shield 64 is mounted to the first stage heat station 50. The second stage of the cold finger extends through an opening in that radiation shield 64. This radiation shield 64 surrounds the primary cryopanel array to the rear and sides to minimize heating of the primary cryopanel array by radiation. The temperature of the radiation shield may range from as low as 40K at the heat station 50 to as high as 130K adjacent to the opening 68 to an evacuated chamber.

A frontal cryopanel array 70 serves as both a radiation shield for the primary cryopanel array and as a cryopumping surface for higher boiling temperature gases such as water vapor. This panel comprises a circular array of concentric louvers and chevrons 72 joined by a spoke-like plate 74. The configuration of this cryopanel 70 need not be confined to circular, concentric components; but it should be so arranged as to act as a radiant heat shield and a higher temperature cryopumping panel while providing a path for lower boiling temperature gases to the primary cryopanel. The frontal cryopanel array 70, while effective at reducing radiation, may tend to impede the flow of gases past the chevrons and louvers.

Also illustrated in FIG. 1 is a heater assembly 69 comprising a tube which hermetically seals electric heating units. The heating units heat the first stage through a heater mount 71 and a second stage through a heater mount 73 for temperature control, particularly during regeneration.

The cryopump is typically attached to a vacuum process chamber via a conduit including a flange 22. In accordance with the present invention, adhesion of a high emissivity surface treatment to a shield surface defined by the interior surface of the conduit forms a radiation shield for the cryopump which can absorb radiation which would otherwise have fallen on the cryopump. Such a surface treatment is typically employed in conjunction with the existing louvers and chevrons, however, in alternate embodiments could be employed alone, if operating conditions permit. Since ideally the conduit is a vessel which is already in the system, no additional conduit length which could impede gaseous flow is imposed. Further, although the emissive and reflective properties are discussed herein with respect to a surface treatment, such properties may also apply to the surface of a conduit formed from a homogeneous substance.

Figure 2:
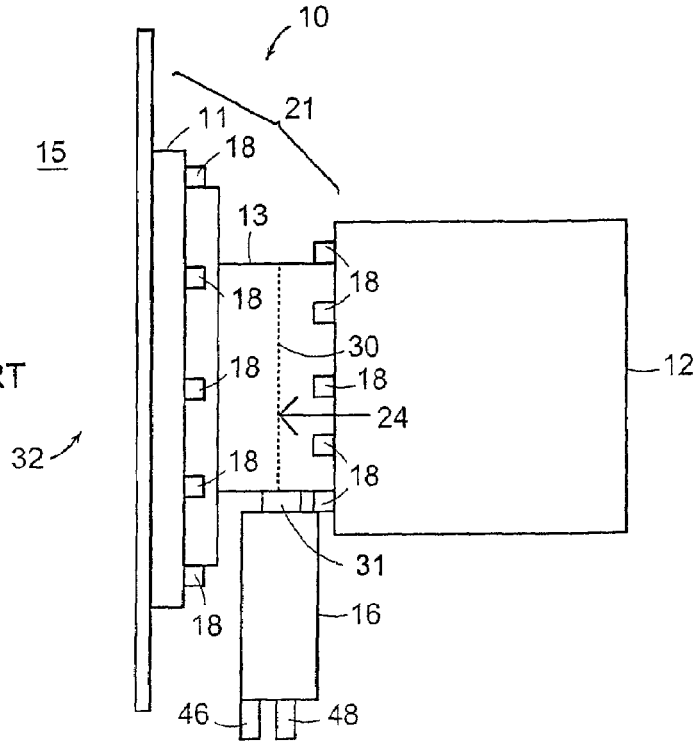
FIG. 2 PRIOR ART
FIG. 2 shows a prior art water pump having a flange for mounting between a vacuum process chamber and a vacuum pump.

FIG. 2 shows a prior art water pump suitable for use with the invention as defined by the present claims. Referring to FIG. 2, a water pump 10 has a pump body 13 with a flange 11 for securing the waterpump to a cryogenic process chamber 15. A fluid conduit 21 having a fluid flow path 32 is defined by the pump body 13 and the flange 11. A cryogenic refrigerator 16 is mounted to the side of pump body 13 and extends laterally from the pump body 13. The refrigerator 16 has a cold finger 31 which is conductively coupled to an optically open flat annular cryopumping array 30 in the pump body 13 for cooling the array 30 to cryogenic temperatures. The array 30 is positioned midway within the pump body 13 and extends along the perimeter of the pump body 13 for condensing water vapor thereon. The orientation plane defined by the array 30 is transverse to the fluid flow path 32 such that the fluid flow path 32 extends through an opening 24 in array 30. Opening 24 is large and centrally located so that array 30 provides little fluid resistance for gases flowing along the fluid flow path 32. Pump body 13 is mounted to a turbomolecular vacuum pump 12 by a series of bolts 18 positioned concentrically about the pump body 13. The flange 11 is similarly mounted to a vacuum process chamber 15. Consequently, there is a direct in-line fluid flow path from the process chamber 15, through the water pump 10 and into turbomolecular pump 12.

In operation, in order to evacuate the process chamber 15, refrigerator 16 is turned on, cooling the array 30 to cryogenic temperatures. Turbomolecular pump 12 is turned on and rotating turbine blades of turbomolecular pump 12 begin to pump gases from process chamber 15 through water pump 10. The non-condensing gases pass through array 30 while water vapor condenses on the surfaces of array 30. The remaining non-condensing gases such as nitrogen and argon are pumped from the system by turbomolecular pump 12. Periodically, when the array 30 becomes full with frost, water pump 10 is regenerated to release the water vapor trapped on the array 30.

The array 30 operates on the principle that gases passing through fluid conduit 32 and the central opening 24 in array 30 flow in a typical molecular flow pattern. Array 30 is capable of trapping about 90% of the water vapor passing through water pump 10. For example, if a 4 inch turbomolecular pump 12 is used without water pump 10, the water pumping speed is only about 250 liters per second at a pressure of about $10^{-5}$ torr. The addition of water pump 10 to turbomolecular pump 12 increases the water pumping speed to about 1300 liters per second at a pressure of about $10^{-5}$ torr.

Continuing to refer to FIG. 2, radiation may be received by the shield surface around the fluid flow path 32, such as the conduit defined by the interior surface of flange 11 and the pump body 13. In the case of the invention as defined by the present claims, adhesion of a surface treatment to the shield surface may absorb radiation which would have otherwise have fallen on the waterpump.

The surface treatment is ideally a substance with a high emissivity, as described further below. Briefly discussing pertinent aspects of radiated electromagnetic energy, the properties of a surface which affect the radiated energy include emissivity $\epsilon$, reflectance r, transmittance t, and absorbency $\alpha$. A further component, scattering, may also affect the radiated energy. The reflectance of a surface is the percentage of total radiation falling on a body which is reflected back from the surface. Reflectance is zero for a blackbody and nearly 1.00 for a highly polished surface. Transmissivity is the percentage of total radiation falling on a body which passes directly through it without being absorbed. Transmissivity is zero for a blackbody and nearly 1.00 for a material like glass. The emissivity of an object is the ratio of radiant energy emitted by that object divided by the radiant energy which a blackbody would emit at the same temperature. Emissivity $\epsilon$ equals absorbency $\alpha$ at a constant temperature. Further, since the total radiation received is either absorbed, reflected, or transmitted:

$$1=\alpha+r+t$$

Figure 3A:
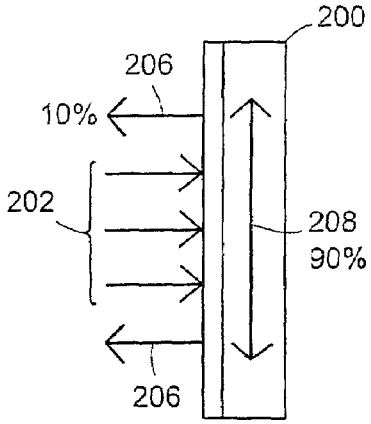
FIGS. 3*a* and 3*b* show surfaces having different emissivity.
Figure 3B:
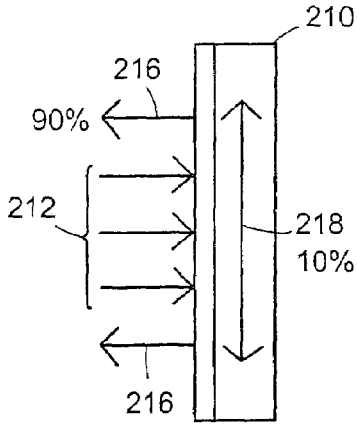

As disclosed herein, the fluid conduit 21 is typically an opaque material in a closed system, therefore transmission and scattering effects are negligible, and accordingly, emissivity and reflectivity are the properties considered herein. Referring to FIGS. 3*a* and 3*b,* two examples of surfaces having different emissivity and reflectivity are shown. Referring to FIG. 3*a,* a surface 200 receives radiant energy as shown by arrows 202. The surface has the following properties:

$$\epsilon=0.9$$

$$r=0.1$$

$$\alpha=0.9$$

Accordingly, 10% of the received energy is reflected, as shown by arrows 206, and the remaining 90% is absorbed, as shown by arrow 208, consistent with the above equations.

Referring to FIG. 3*b,* another surface 210 is shown. Radiant energy is directed at the surface 210, as shown by arrows 212. Surface 210 has the following properties:

$$\epsilon=0.1$$

$$r=0.9$$

$$\alpha=0.1$$

Accordingly, only 10% of the received energy is absorbed, as shown by arrows 218, with the remaining 90% being reflected, as shown by arrows 216.

Accordingly, application of a surface treatment having a high emissivity in the path of gaseous flow to a cryopump can have the effect of absorbing radiation which would have otherwise have fallen on the cryopump. A particular radiation absorbing surface treatment can be applied to a cryopump, water pump, or other cryogenic apparatus as described further below. In a particular embodiment, the emissivity of the surface treatment should be greater than 0.8, so that sufficient radiation may be absorbed. However, emissive properties of even a small degree will tend to absorb more energy than is emitted if the emissive surface is maintained at a low temperature relative to the radiation source.

Figure 3C:
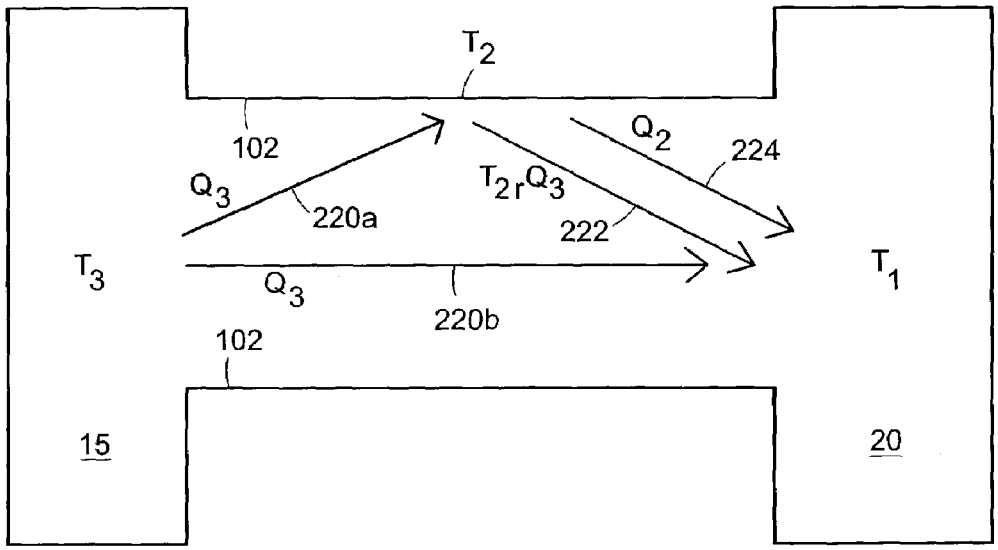
FIG. 3*c* shows the effect of emissivity and temperature on a cryopump.

FIG. 3*c* shows a general example of radiation activity in a cryopump. Radiation emitted from a body varies with temperature. The Stefan-Boltzman law indicates that the radiation emitted increases as the fourth power of the absolute temperature:

$$Q=A\sigma\epsilon T^4$$

where $\sigma$ is the Stefan's constant, $5.67*10^{-8}Wm^{-2}*K^{-4}$ and A is the area. This law illustrates that as the temperature of a radiated body increases, the emitted energy increases exponentially. Conversely, if the temperature decreases, emitted radiation can be reduced by an exponential amount. Therefore, by keeping the temperature of an emissive body relatively low, emitted radiation is limited, while, since the surface is not reflective, radiation is still absorbed.

Referring to FIG. 3*c,* the process chamber 15 has temperature T3 and surfaces with emissivity e3, and emits radiation toward the cryopump 20. Some of the radiation $Q_3$ from the chamber 15 will strike surface 102, as shown by arrow 220*a* and some will be transmitted directly, as shown by arrow 220*b*. A portion of the radiation striking the surface 102 will be reflected, and a portion will be absorbed, according to the reflectivity r of the surface 102. The portion reflected is shown by arrow 222. The portion absorbed will cause the surface 102 to warm. Surface 102 will emit radiation $Q_2$ according to its emissivity and temperature, as shown by arrow 224.

In a typical vacuum environment, the temperature in the process chamber is relatively higher than the cryopump 20 or the surface 102, and therefore the process chamber tends to be the primary source of radiation, because of the $T_3^4$ term. Similarly, if the surface 102 has a high emissivity and is maintained at a relatively low temperature, the reflected energy and $T_2^4$ terms remain relatively small, resulting in reduced radiation emitted or reflected onto the cryopump from the surface 102.

Figure 4A:
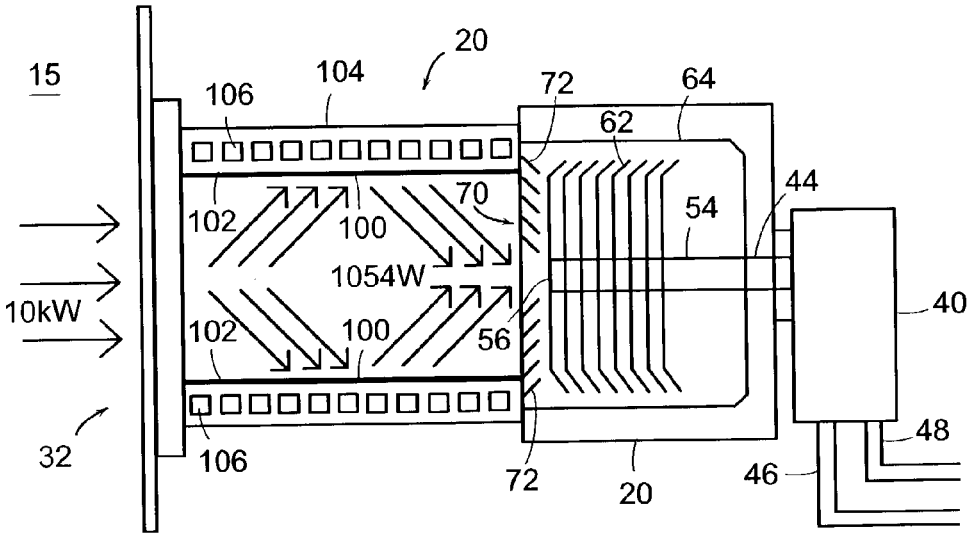
FIG. 4*a* shows a cryopump employing the surface of FIG. 3*a;*
Figure 4B:
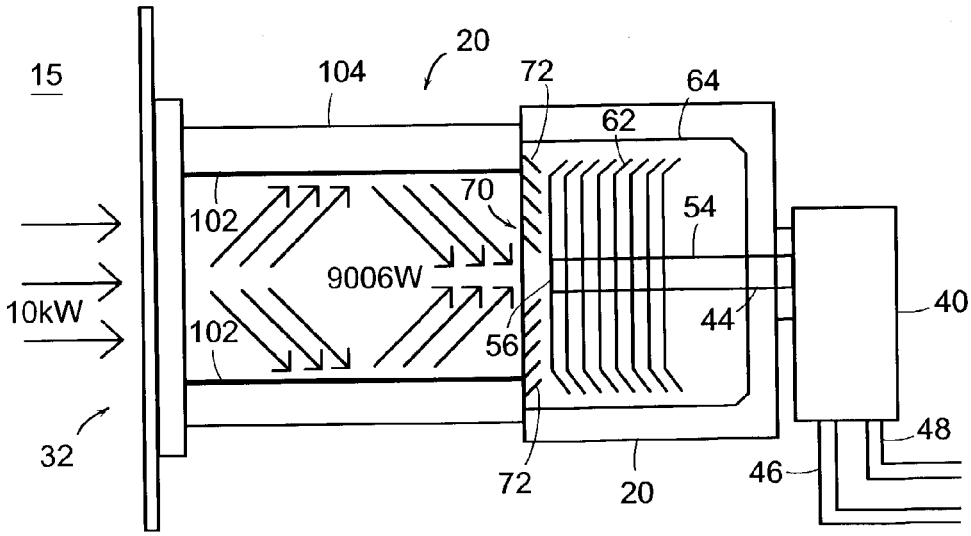
FIG. 4B PRIOR ART
FIG. 4*b* shows a cryopump employing the surface of FIG. 3*b;*

FIGS. 4*a* and 4*b* show an example of radiation activity in a cryopump employing the surface treatments of FIGS. 3*a* and 3*b*. Referring to FIGS. 4*a* and 4*b,* radiation emission and absorption according to the above equations are illustrated. FIG. 4*a* shows the effect of the highly emissive substance of FIG. 3*a* employed as a surface treatment 100 on a shield surface 102 defined by the interior of a vacuum conduit 104 between a process chamber 15 and a cryopump 20. The vacuum conduit 104 has embedded channels 106 for carrying water for drawing heat off the interior surface 102. In this example, we assume a typical operating scenario in which the process chamber 15 emits 10 kW onto the conduit surface 102 and the conduit 104 is cooled to 300K, or room temperature. Note that additional radiation shielding in the form of chevrons and louvers 72 may be employed and also that some radiation may pass directly through the conduit without contacting the conduit surface 102, however, for purposes of this illustration, we assume 10 kW fall on the conduit surface 102 from the process chamber 15. Therefore, the radiation reflected is:

$$Q_{reflect}=10\text{ kW}*0.1=1\text{ kW}$$

and the radiation absorbed is:

$$Q_{absorb}=10\text{ kW}*0.9=9\text{ kW}$$

The absorbed radiation, however, results in emitted radiation back onto the cryopump, as follows. For this example, the conduit 104 shown is 20 cm in diameter and 20 cm long. For simplification, assume that we ignore the effects of radiation from the cryopump, and assume further that all the radiation reflected and emitted from the surface 102 falls on the cryopump. In actuality, these effects would further reduce the radiation falling on the cryopump; however, the example herein will be illustrative, nonetheless. As indicated above, the conduit has an interior surface with the properties of the material shown in FIG. 3*a*. The interior surface area is $\pi$*diameter*length, or about 1200 $cm^2$. Assume further that an ideal blackbody emits 0.05 $w/cm^2$ at 300K. The ideal blackbody would emit:

$$Q_{black}=1200\text{ cm}^2*0.05\text{ w/cm}^2=60\text{ W}$$

The surface material shown in FIG. 3*a* has an emissivity of 0.9. Therefore, in the example, the conduit of FIG. 4*a* emits:

$$Q_{emit}=1200\text{ cm}^2*(0.05*0.9)\text{W/cm}^2=54\text{ W@300K}$$

Consistent with the two assumptions described above. Note that the actual radiation falling on the cryopump would be less, because the cryopump emits some radiation back to the chamber and because not all the emitted radiation falls on the cryopump. Accordingly, the total radiation falling on the cryopump is the sum of radiation reflected and radiation emitted in all directions:

$$Q_{cryo}=1000\ W+54\ W=1054\ W$$

The surface treatment 100 maybe an emissive substance such as paint, amythrocite, polytetrafluoroethylene (TEFLON®), oxide or glass adapted to absorb radiation. Since it is applied to the interior surface of the vacuum conduit 104, it ideally has low outgassing properties so as to not compromise the vacuum environment.

Referring now to the prior art of FIG. 4*b* a conduit having interior properties of the material of FIG. 3*b* is shown. The surface material shown in FIG. 4*b* has a reflectivity of 0.9 and an emissivity of 0.1, and further assume that it is also at 300K. Therefore, in the example, the shield surface 102 of FIG. 4*b* reflects:

$$Q_{reflect}=10\ kW*0.9=9\ kW$$

and absorbs:

$$Q_{absorb}=10\ kW*0.1=1\ kW$$

Further, the radiation absorbed results in radiation emitted:

$$Q_{emit}=1200\ cm^2*(0.05*0.1)w/cm^2=6\ W$$

The total radiation falling on the cryopump, therefore, is:

$$Q_{cryo}=9000\ W+6\ W=9006\ W$$

In contrast to the vacuum conduit shown in FIG. 4*a,* the total radiation falling on the cryopump is increased because more radiation is reflected from the interior shield surface 102 of the conduit. Since the highly emissive interior surface 100 of the vacuum conduit 104 shown in FIG. 4*a* absorbs heat and gets warmer than room temperature, it radiates some more heat to the cryopump. However, since its temperature is lower than the heat source in the process chamber, the emitted radiation is of lower intensity than that which arrives. By water cooling the outside of the conduit, for example, the temperature of the interior surface can be maintained near room temperature despite absorbing high levels of radiation, thereby reducing radiation transfer to the cryopump. The highly emissive vacuum conduit surface absorbs heat from the process chamber radiation source and emits little energy of its own. Therefore, by forming a highly emissive vacuum conduit surface and by keeping it at a relatively low temperature, such as room temperature, a small amount of emitted radiation is sacrificed while absorbing a relatively large amount which would otherwise be reflected.

Figure 5:
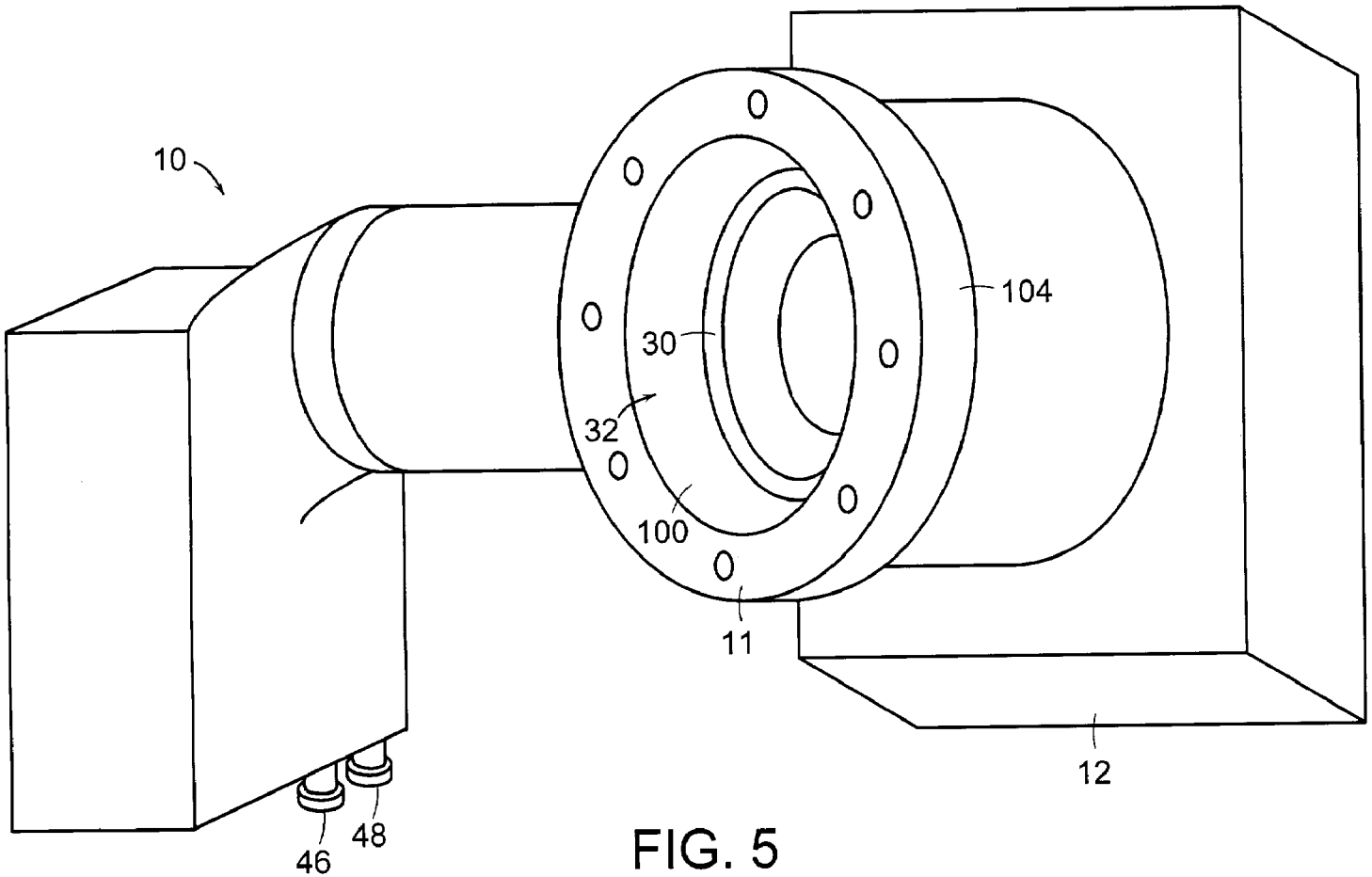
FIG. 5 shows a perspective view of a water pump having a surface treatment for absorbing radiation.

FIG. 5 shows a particular embodiment adapted for a water pump 10 including the surface treatment 100 for absorbing radiation. The vacuum conduit 104 is defined by the flange 11 adjacent to the cryopumping surface 30 and adapted to be attached between a vacuum process chamber and a turbomolecular pump or other vacuum-producing apparatus. As in the cryopump embodiment of FIG. 4*a,* the surface treatment 100 is disposed in the fluid flow path 32 for absorbing radiation.

Figure 6A:
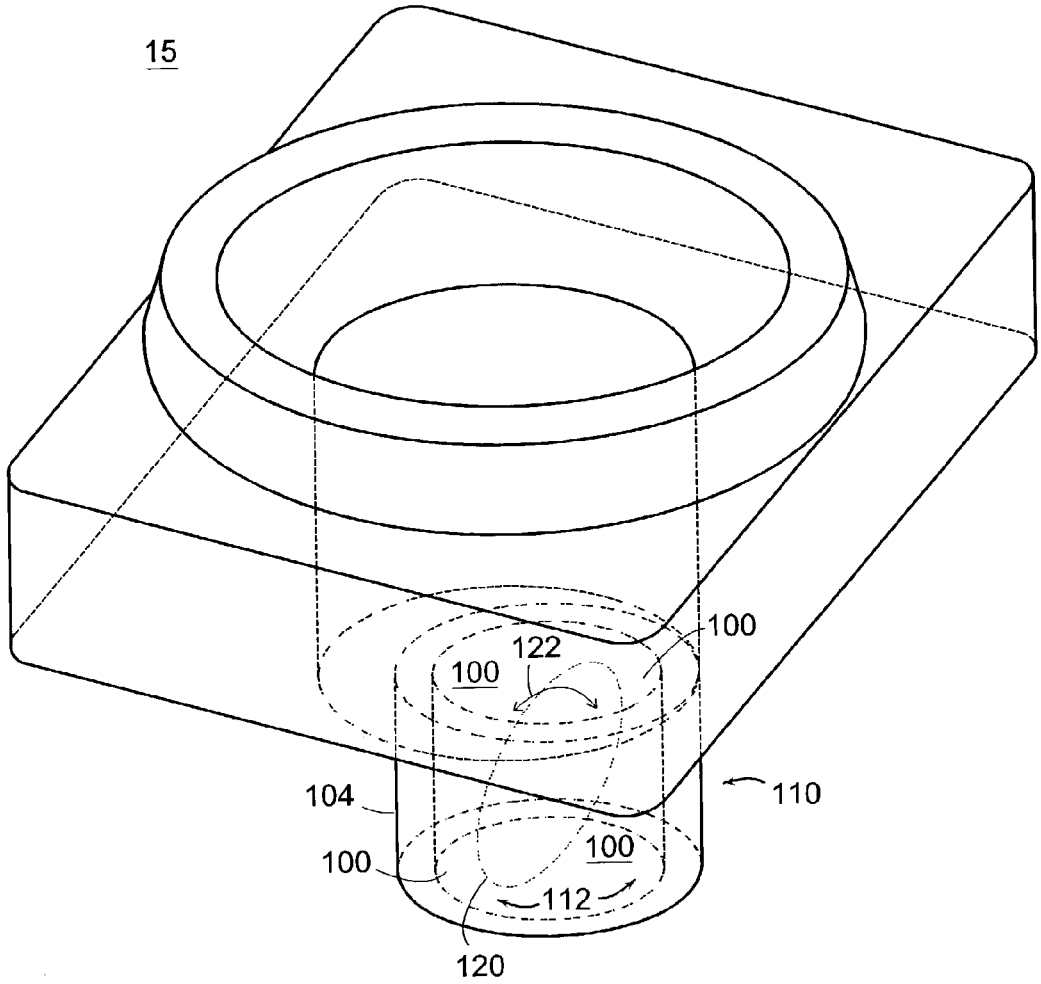
FIG. 6*a* shows a perspective view of a vatterfly valve assembly employing a surface treatment.
Figure 6B:
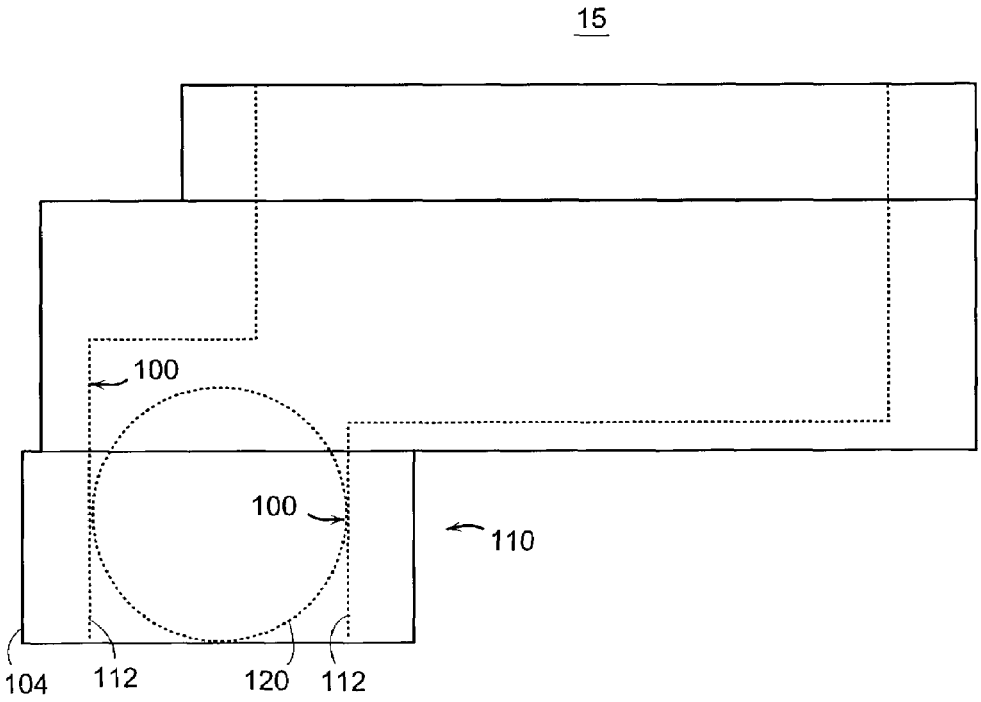
FIG. 6*b* shows a side view of the vatterfly valve assembly of FIG. 6*a*.

FIGS. 6*a* and 6*b* show another particular embodiment adapted for a cryopump employing a vatterfly valve. The vacuum conduit 104 is defined by the interior of a vatterfly valve 110. The vatterfly valve is adapted to be disposed between a vacuum process chamber 15 and a vacuum pump (not shown). The surface treatment 100 is applied to the interior walls 112 of the vatterfly valve 110. A valve plate 120 is operable to rotate 90° as shown by arrow 122 for sealing off the process chamber 15. As described above, the surface treatment is highly emissive so as to absorb radiation, and has low outgassing properties.

While this invention has been particularly shown and described with references to preferred embodiments thereof, it will be understood by those skilled in the art that various changes in form and details may be made therein without departing from the scope of the invention encompassed by the appended claims. Accordingly, the present invention is not intended to be limited except by the following claims.

What is claimed is:

1. A vacuum system comprising:

a vacuum conduit having an interior conduit surface;

a cryogenic vacuum pump disposed at one end of the vacuum conduit;

a process chamber disposed at an opposed end of the vacuum conduit and adapted to be evacuated by the cryogenic vacuum pump; and a surface treatment along at least a portion of the interior conduit surface comprising an emissivity of greater than about 0.8 to absorb thermal radiation the surface treatment being in a region of the interior conduit surface in a direct flow path between the process chamber and all cryogenic condensing surfaces of the cryogenic vacuum pump.

2. The vacuum system of claim 1 wherein the surface treatment comprises an emissive substance.

3. The vacuum system of claim 1 wherein the surface treatment is a material selected from the group consisting of polytetrafluoroethylene, amythrocite, oxide, and glass.

4. The vacuum system of claim 1 further comprising a means for drawing heat off the interior surface.

5. The vacuum system of claim 4, wherein the means for drawing heat off the interior surface comprises embedded channels.

6. A method of shielding a cryogenic vacuum pump from radiation comprising:

providing a vacuum conduit having an interior that serves as a fluid flowpath between the cryogenic vacuum pump and a process chamber adapted to be evacuated by the cryogenic vacuum pump, at least a portion of the interior of the vacuum conduit having a surface treatment comprising an emissivity of greater than about 0.8 and being in a region of the fluid flowpath directly between the process chamber and all cryogenic condensing surfaces of the cryogenic vacuum pump; and absorbing radiant energy from the fluid flowpath using the applied surface treatment.

7. The method of claim 6 wherein the surface treatment comprises an emissive substance.

8. The method of claim 6 wherein the surface treatment is a material selected from the group consisting of polytetrafluoroethylene, amythrocite, oxide, and glass.

9. The method of claim 6 further comprising cooling the vacuum conduit.

10. The method of claim 9 wherein cooling comprises water cooling the vacuum conduit.

11. A vacuum system comprising:

a vacuum conduit having an interior conduit surface;

a cryogenic vacuum pump disposed at one end of the vacuum conduit, the cryogenic vacuum pump comprising a primary cryopanel array, a radiation shield surrounding the primary cryopanel array and a frontal cyropanel array across an opening of the radiation shield;

a process chamber disposed at an opposed end of the vacuum conduit and adapted to be evacuated by the cryogenic vacuum pump through the vacuum conduit; and a surface treatment along at least a portion of the interior conduit surface comprising an emissivity of greater than about 0.8 to absorb thermal radiation.

12. The vacuum system of claim 11 wherein the surface treatment comprises an emissive substance.

13. The vacuum system of claim 11 wherein the surface treatment is a material selected from the group consisting of polytetrafluoroethylene, amythrocite, oxide, and glass.

14. The vacuum system of claim 11 further comprising a means for drawing heat off the interior surface.

15. The vacuum system of claim 14, wherein the means for drawing heat off the interior surface comprises embedded channels.

16. A method of shielding a cryogenic vacuum pump from radiation comprising:

providing a vacuum conduit having an interior adapted to provide a fluid flowpath between the cryogenic vacuum pump and a process chamber adapted to be evacuated by the cryogenic vacuum pump, the cryogenic vacuum pump comprising a primary cryopanel array, a radiation shield surrounding the primary cryopanel array and a frontal cryopanel array across an opening of the radiation shield, at least a portion of the interior of the vacuum conduit having a surface treatment comprising any emissivity of greater than about 0.8; and absorbing radiant energy from the fluid flowpath using the surface treatment.

17. The method of claim 16 wherein the surface treatment comprises an emissive substance.

18. The method of claim 16 wherein the surface treatment is a material selected from the group consisting of polytetrafluoroethylene, amythrocite, oxide, and glass.

19. The method of claim 16 further comprising cooling the vacuum conduit.

20. The method of claim 19 wherein cooling the vacuum conduit comprises water cooling the vacuum conduit.

* * * * *